US007054578B2

(12) United States Patent
Jung et al.

(10) Patent No.: US 7,054,578 B2
(45) Date of Patent: May 30, 2006

(54) SYSTEM TO REPLACE A PHOTOSENSITIVE UNIT AND A TRANSFER UNIT AND A PRINTER HAVING THE SYSTEM

(75) Inventors: Woo-chul Jung, Yongin-si (KR); Heung-sup Jeong, Suwon-si (KR); Byeong-hwa Ahn, Seongnam-si (KR); Kyung-shig Chung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 80 days.

(21) Appl. No.: 10/822,001

(22) Filed: Apr. 12, 2004

(65) Prior Publication Data

US 2005/0002687 A1 Jan. 6, 2005

(30) Foreign Application Priority Data

Jul. 5, 2003 (KR) ..... 10-2003-0045525

(51) Int. Cl.
*G03G 15/00* (2006.01)
*G03G 15/02* (2006.01)
*G03G 15/08* (2006.01)

(52) U.S. Cl. ..... 399/110; 399/116; 399/121

(58) Field of Classification Search ..... 399/25, 399/26, 110, 113, 116, 121
See application file for complete search history.

(56) References Cited

U.S. PATENT DOCUMENTS

| | | | | |
|---|---|---|---|---|
| 5,371,575 | A * | 12/1994 | Sekino et al. | 399/25 |
| 5,587,769 | A * | 12/1996 | Sawada et al. | 399/113 |
| 5,802,427 | A * | 9/1998 | Sawada et al. | 399/122 |
| 5,845,176 | A * | 12/1998 | Yoshida et al. | 399/113 |
| 5,983,062 | A * | 11/1999 | Sameshima | 399/110 |
| 6,088,555 | A * | 7/2000 | Mizuno | 399/113 |
| 6,115,568 | A * | 9/2000 | Sameshima | 399/110 |
| 6,522,845 | B1 * | 2/2003 | Sameshima | 399/88 |
| 2004/0009008 | A1 * | 1/2004 | Park et al. | 399/116 |

FOREIGN PATENT DOCUMENTS

| | | |
|---|---|---|
| JP | 11-295998 | * 10/1999 |
| JP | 2001-42431 | 2/2001 |
| KR | 10-462613 | 7/2002 |

OTHER PUBLICATIONS

Office Action issued on Apr. 28, 2005, for Korean Patent Application No.: 2003-45525 (listing 1 reference).

* cited by examiner

*Primary Examiner*—Sandra L. Brase
(74) *Attorney, Agent, or Firm*—Stanzione & Kim, LLP

(57) ABSTRACT

A system to replace a photosensitive unit and a transfer unit in a printer includes a frame provided in a printer body, and a locking unit which is provided in the frame and simultaneously locks and unlocks the photosensitive unit and the transfer unit that enter via an entrance of the printer body and are seated in a mounting location. The locking unit may include a rotating lever, a rotating cam, and a connection bar which connects the rotating cam to the rotating lever.

28 Claims, 9 Drawing Sheets

SYSTEM TO REPLACE A PHOTOSENSITIVE UNIT AND A TRANSFER UNIT AND A PRINTER HAVING THE SYSTEM

CROSS-REFERENCE TO RELATED APPLICATIONS

This application claims the priority of Korean Patent Application No. 2003-45525, filed on Jul. 5, 2003, in the Korean Intellectual Property Office, the disclosure of which is incorporated herein in its entirety by reference.

BACKGROUND OF THE INVENTION

1. Field of the Invention

The present invention relates to a system to replace a photosensitive unit and a transfer unit, and a printer using the system.

2. Description of the Related Art

In general, a printer or a copier includes a photosensitive unit which develops an image, and a transfer unit which transfers the developed image onto paper. However, when the photosensitive unit and the transfer unit are used for a long time, the quality of the image is gradually lowered. Thus, when an expected life span of the photosensitive unit and the transfer unit has elapsed, the units should be replaced so that a clean image can be developed continuously.

FIGS. 1 through 5 illustrate a conventional system for replacing a photosensitive unit and a transfer unit in a printer.

Referring to FIGS. 1 through 5, a photosensitive unit 10 and a transfer unit 20 are supported to slide along first and second guide rails 41 and 42, respectively, provided inside a printer. In order to replace the photosensitive unit 10 and the transfer unit 20 with new units, first, a door (not shown) provided on a front surface of the printer is opened, and a locking lever 30, which locks the photosensitive unit 10, is pushed, as shown in FIG. 2. In this case, the locking lever 30 lifts the transfer unit 20 by a predetermined height such that the transfer unit 20 is separated from the photosensitive unit 10. Then, as shown in FIG. 3, a handle 11 of the photosensitive unit 10 is grasped, and the photosensitive unit 10 is pulled along the first guide rail 41 to be removed from the printer. Thereafter, as shown in FIG. 4, the locking lever 30 is lowered in an original location. As shown in FIG. 5, a first handle 21 of the transfer unit 20 is grasped, and the transfer unit 20 is pulled along the second guide rail 42 to be removed from the printer. In this case, when the transfer unit 21 is removed to some degree, a second handle 22, installed on a top surface of the transfer unit 20, is pulled and grasped so that the transfer unit 20 does not fall. Thereafter, mounting a new unit is performed in a reverse order.

However, in such a replacing system, whenever the photosensitive unit 10 and the transfer unit 20 are removed or installed, the locking lever 30 should be repeatedly lowered or lifted. In addition, since each of the photosensitive unit 10 and the transfer unit 20 is grasped, pulled, and removed from the printer, the photosensitive unit 10 and the transfer unit 20 may fall down and become damaged if they deviate from the first and second guide rails 41 and 42 and are removed carelessly while operating.

SUMMARY OF THE INVENTION

In order to solve the foregoing and/or other problems, it is an aspect of the present invention to provide a system to replace a photosensitive unit and a transfer unit in a printer by which replacing the photosensitive unit and the transfer unit can be safely and easily performed, and a printer having the system.

Additional aspects and advantages of the invention will be set forth in part in the description which follows and, in part, will be obvious from the description, or may be learned by practice of the invention.

The foregoing and/or other aspects of the present invention may be achieved by providing a system to replace a photosensitive unit and a transfer unit in a printer, the system comprising a frame provided in a printer body, and a locking unit to be provided in the frame and to simultaneously lock and unlock the photosensitive unit and the transfer unit that enter the printer via an entrance of the printer body to be seated in a mounting location.

The foregoing and/or other aspects of the present invention may also be achieved by providing a printer comprising a photosensitive unit to form an image to be printed through exposure and development operations, a transfer unit which transfers the image formed on the photosensitive unit onto paper, and a system to replace the photosensitive unit and the transfer unit, wherein the system includes a frame provided in a printer body, and a locking unit, which is provided in the frame and simultaneously locks and unlocks the photosensitive unit and the transfer unit that enter the printer via an entrance of the printer body and are seated in a mounting location.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
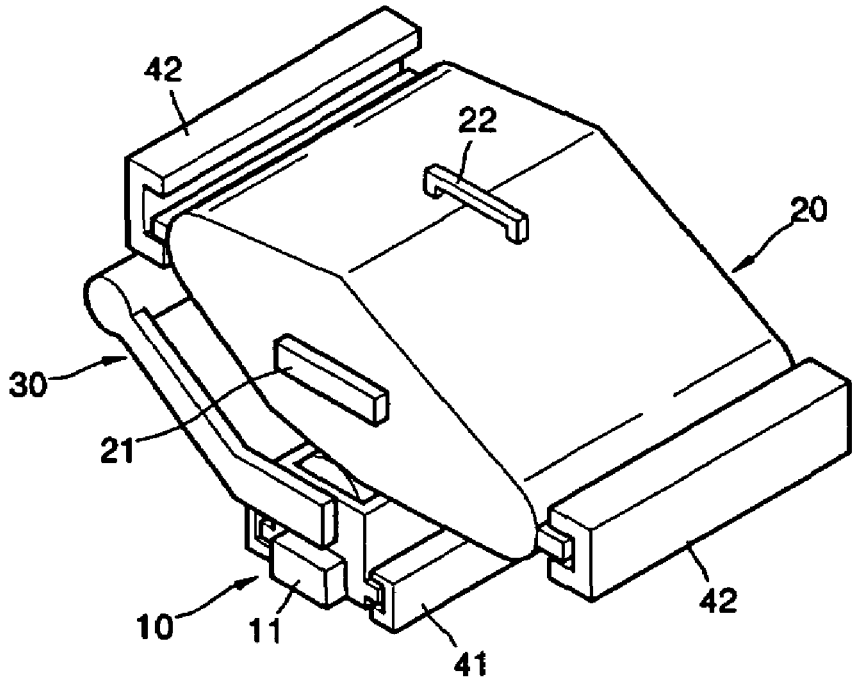
FIG. 1 (PRIOR ART)
FIGS. 1 through 5 illustrate a conventional system for replacing a photosensitive unit and a transfer unit.
Figure 2:
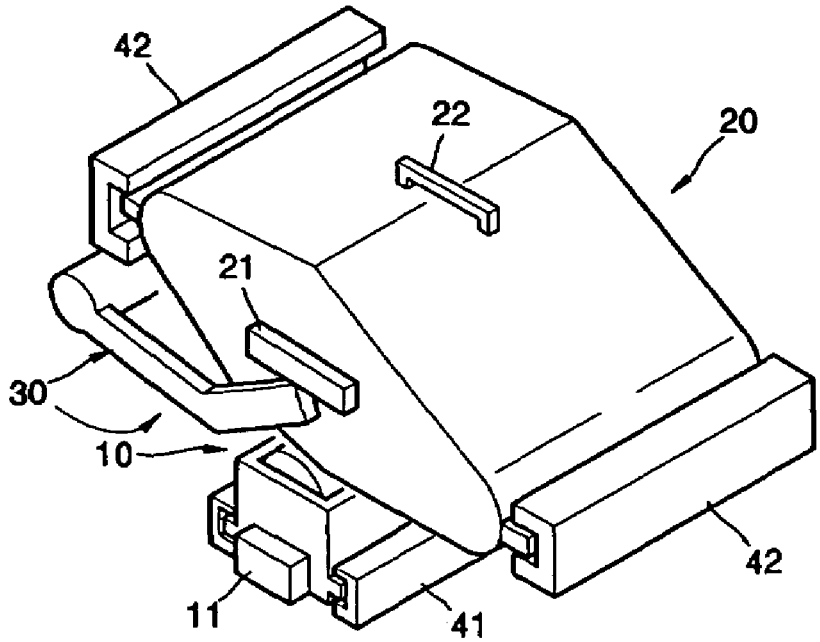
FIG. 2 (PRIOR ART)
Figure 3:
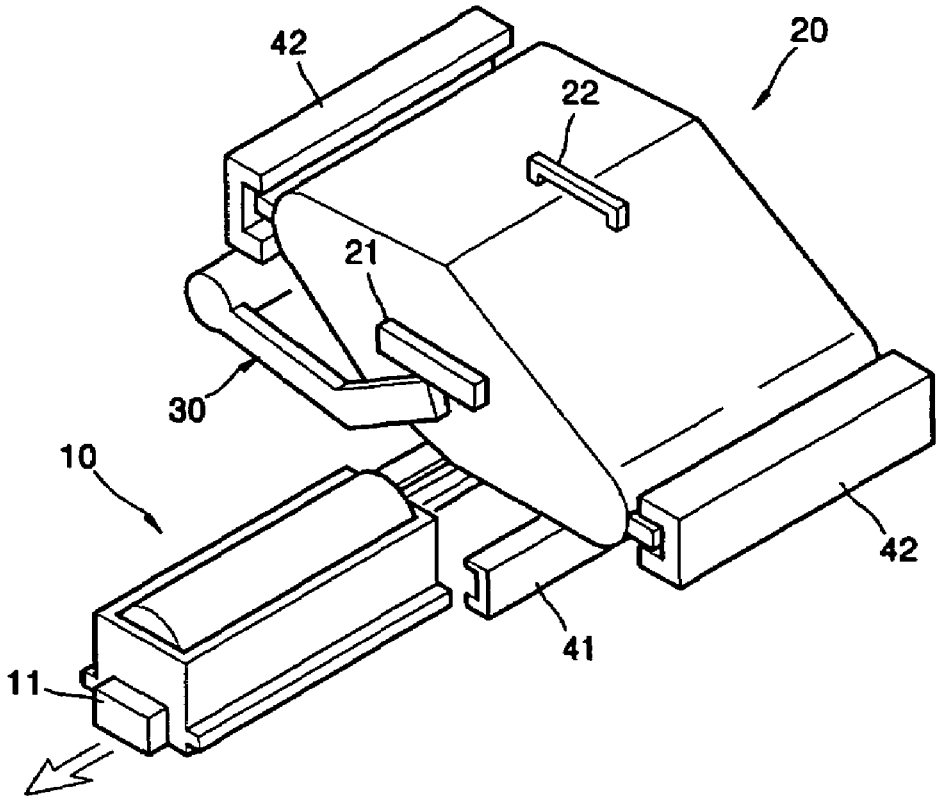
FIG. 3 (PRIOR ART)
Figure 4:
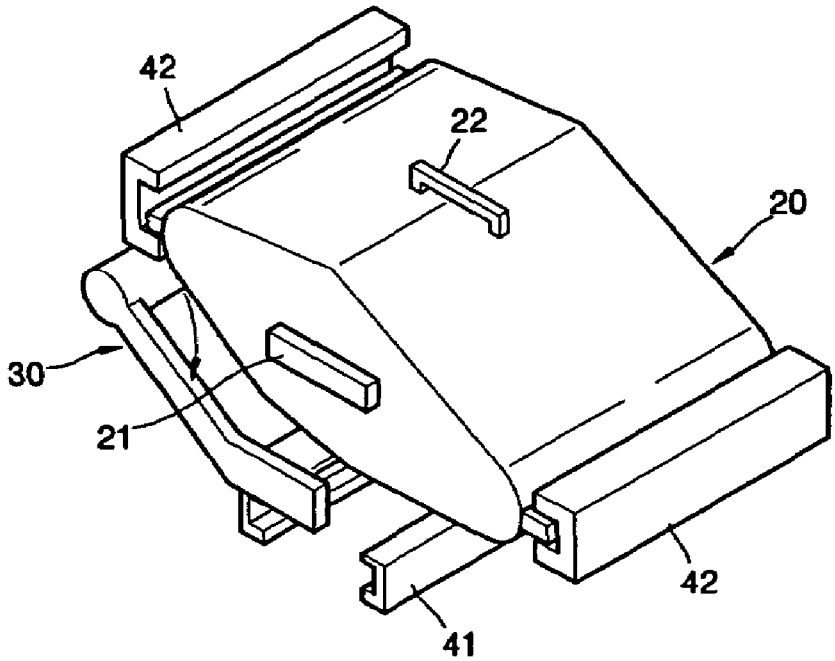
FIG. 4 (PRIOR ART)
Figure 5:
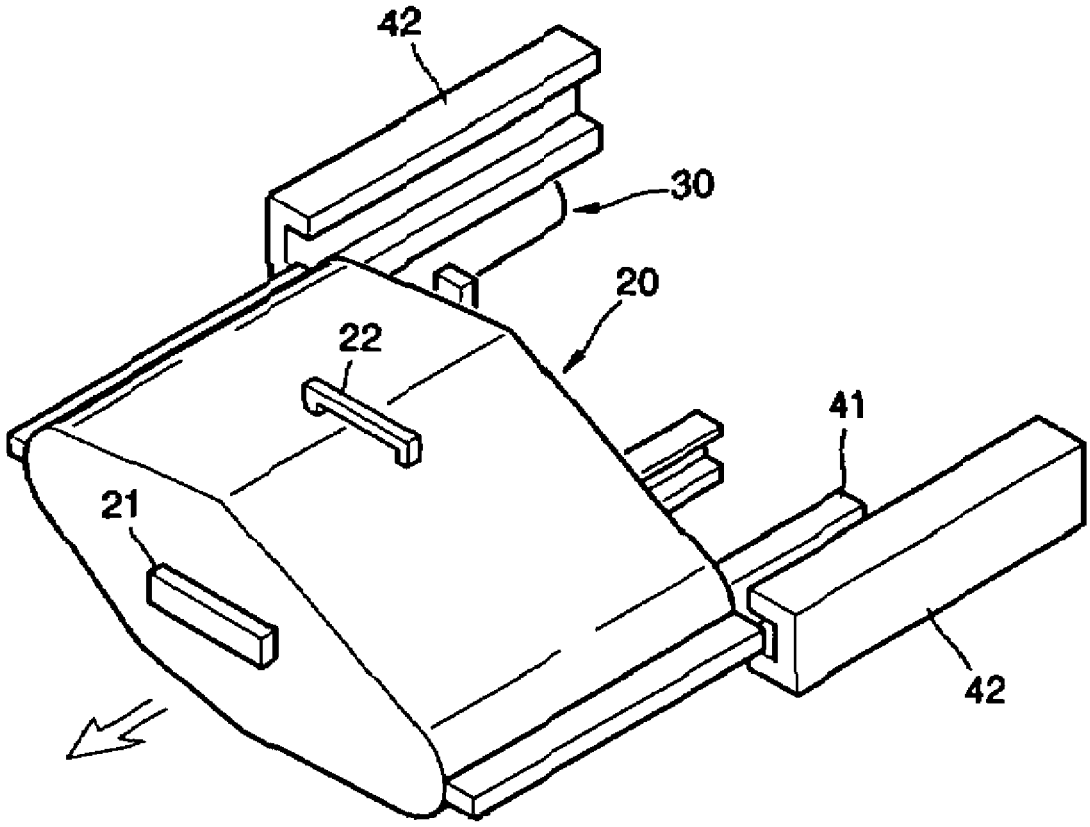
FIG. 5 (PRIOR ART)

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIGS. 6 through 11 illustrate a system to replace a photosensitive unit and a transfer unit, according to the present invention.

Figure 6:
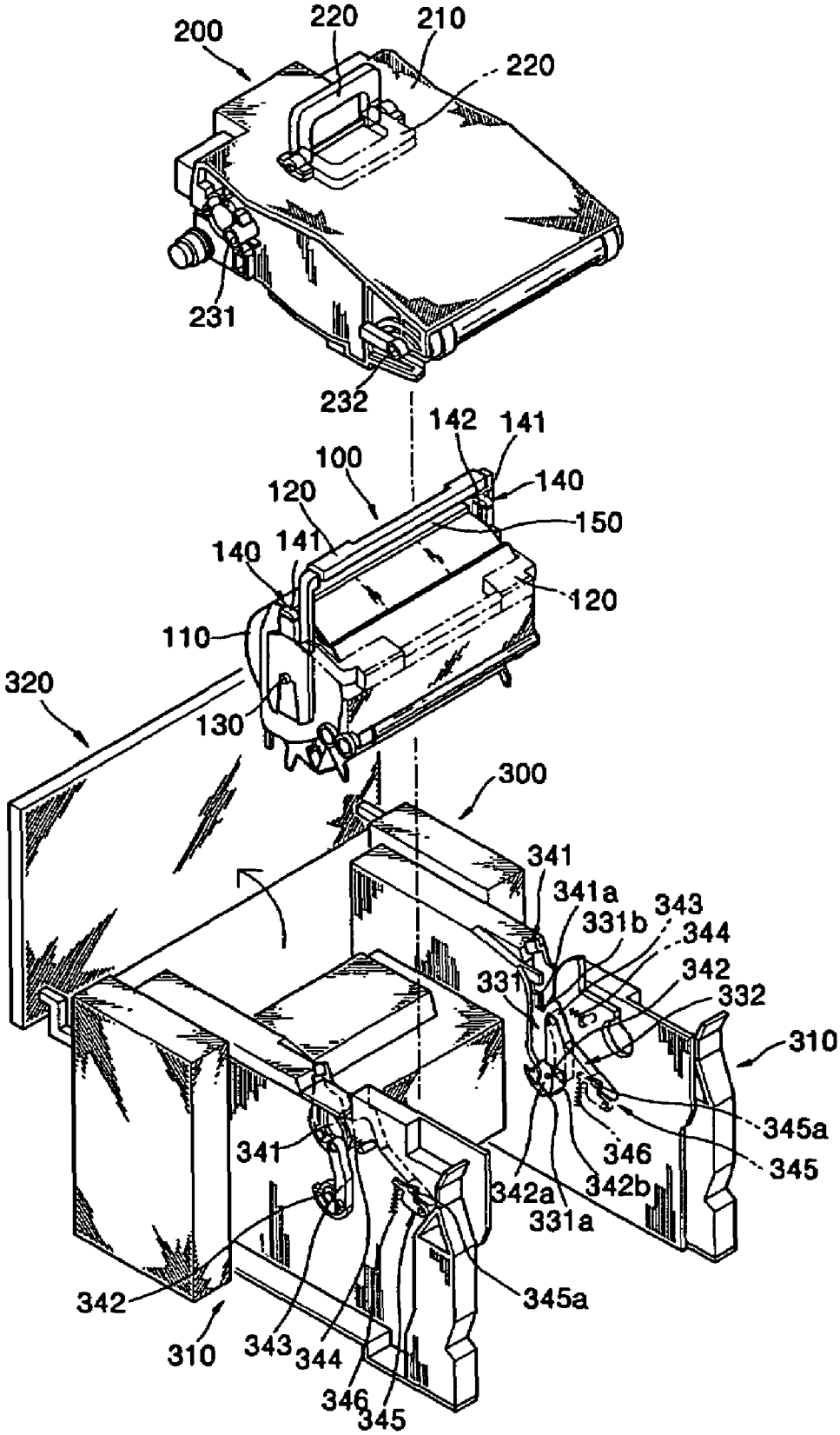
FIG. 6 illustrates a system to replace a photosensitive unit and a transfer unit, according to the present invention.

Referring to FIG. 6, an entrance, which is opened and closed by a door 320, is formed in an upward direction of a mounting portion of a printer body 300 in which a photosensitive unit 100 and a transfer unit 200 are to be mounted. Replacement of the photosensitive unit 100 and the transfer unit 200 is performed via the entrance. In addition, one or more frames 310 are installed in the mounting portion of the printer body 300, and first and second guide rails 331 and 332 are provided in each frame 310. A first guide protrusion 130 of the photosensitive unit 100 and a first guide protrusion 231 of the transfer unit 200, which enter from an upward direction to a downward direction via the entrance, are guided along the first guide rail 331. A second guide protrusion 232 of the transfer unit 200 is guided along the second guide rail 332.

The photosensitive unit 100 includes a photosensitive drum 110, a case 150 that covers a part of the photosensitive drum 110, and a handle 120. The handle 120 is rotatably coupled with the case 150. Thus, the handle 120 is pulled up from an original location when the photosensitive unit 100 is lifted, and is pushed down to the original location after an operation of replacing the photosensitive unit 100 is performed. The photosensitive unit 100 further includes a damping member 140 including a spring 142 and a shock-absorbing bar 141. The damping member 140 elastically supports the transfer unit 200, which is to be directly placed on the photosensitive unit 100 inside the printer body 300.

The transfer unit 200 includes a case 210 which covers a transfer belt (not shown), and a handle 220 which is installed on a top surface of the case 210. A bottom surface of the case 210 is opened to access the photosensitive drum 110 and paper (not shown). In addition, the handle 220 is rotatably installed in the case 210. When the handle 220 is not used, it is folded to be closely attached to the case 210.

Referring to FIGS. 6–11, the system further includes two locking units installed in the respective frames 310 to lock the photosensitive unit 100 and the transfer unit 200, which are mounted in the printer body 300 along the first and second guide rails 331 and 332 in place. The two locking units face each other. That is, the locking units are symmetrical. Each locking unit includes a rotating lever 341 which is rotatably operated by a user to be rotated by hand to control a first locking portion 341*a* formed to lock the transfer unit 200 so that the transfer unit 200 does not deviate from the first guide protrusion 231.

If the photosensitive unit 100 and the transfer unit 200 are mounted in the printer body 300 along the first and second guide rails 331 and 332 and then the rotating lever 341 is rotated, the first locking portion 341*a* of the rotating lever 341 covers the first guide protrusion 231 of the transfer unit 200 to lock the transfer unit 200 in place. In this case, the transfer unit 200 presses the damping member 140. The photosensitive unit 100 is locked in place by a pressure applied upwards by the damping member 140 being pressed downward by the transfer unit 200 in a state where the first guide protrusion 130 of the photosensitive unit 100 is seated on a lower seating portion 331*a*. Thus, by operating the rotating lever 341, the transfer unit 200 and the photosensitive unit 100 are simultaneously locked in place. A spring 344 elastically biases the rotating lever 341 in an unlocking direction. However, unless the user rotates the rotating lever 341 in the unlocking direction, the rotating lever 341 is maintained in a locked position by a reaction force of the damping member 140 in spite of an elastic force of the spring 344.

The locking unit may further include a rotating cam 342, which is rotatably installed in the frame 310 to lock the photosensitive unit 100 seated on the lower seating portion 331*a* in place, and a connection bar 343, which connects the rotating lever 341 and the rotating cam 342 so that they move together in one direction of the locking direction and the unlocking direction. The rotating cam 342 includes a rail portion 342*a* connected to the first guide rail 331 and a second locking portion 342*b* which locks the photosensitive unit 100 in place by pressing the guide protrusion 130 of the photosensitive unit 100.

Figure 7:
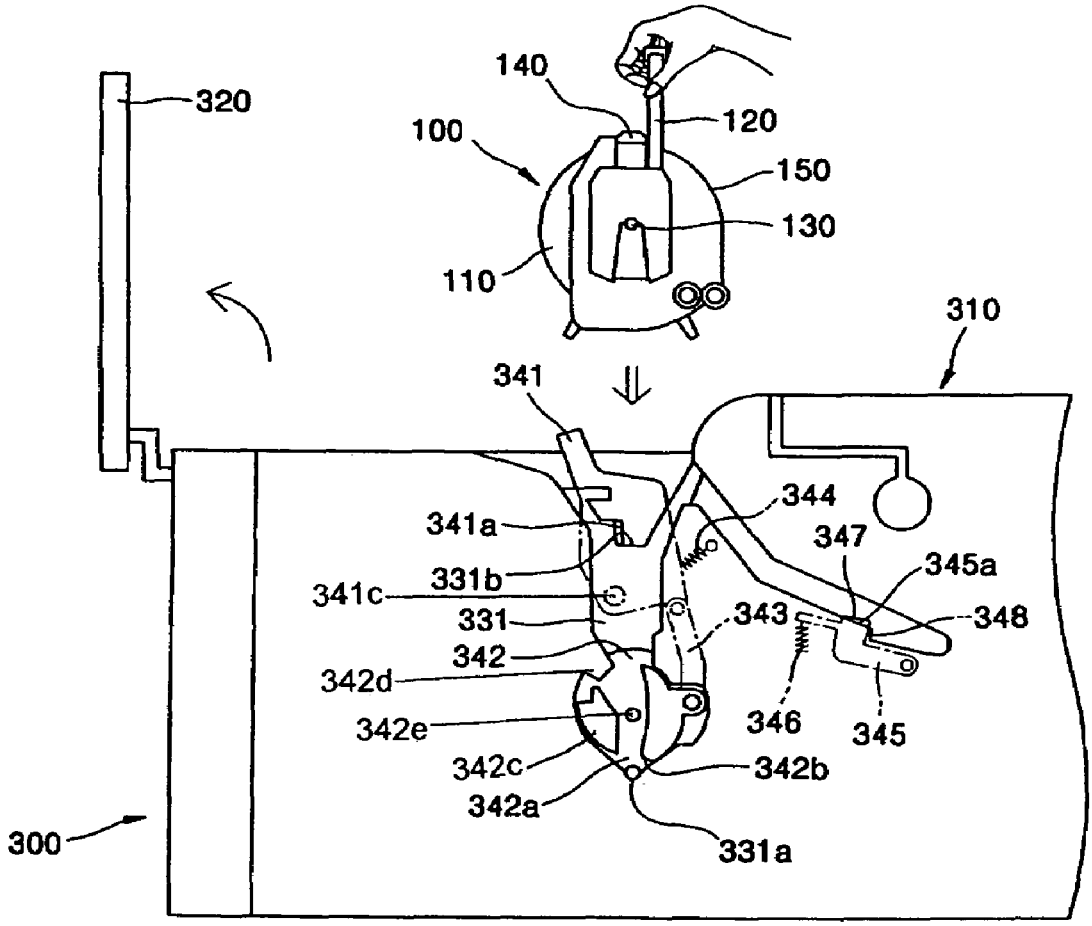
FIGS. 7 through 11 illustrate a method of replacing a photosensitive unit and a transfer unit using the system shown in FIG. 6, according to another embodiment of the present invention.
Figure 11:
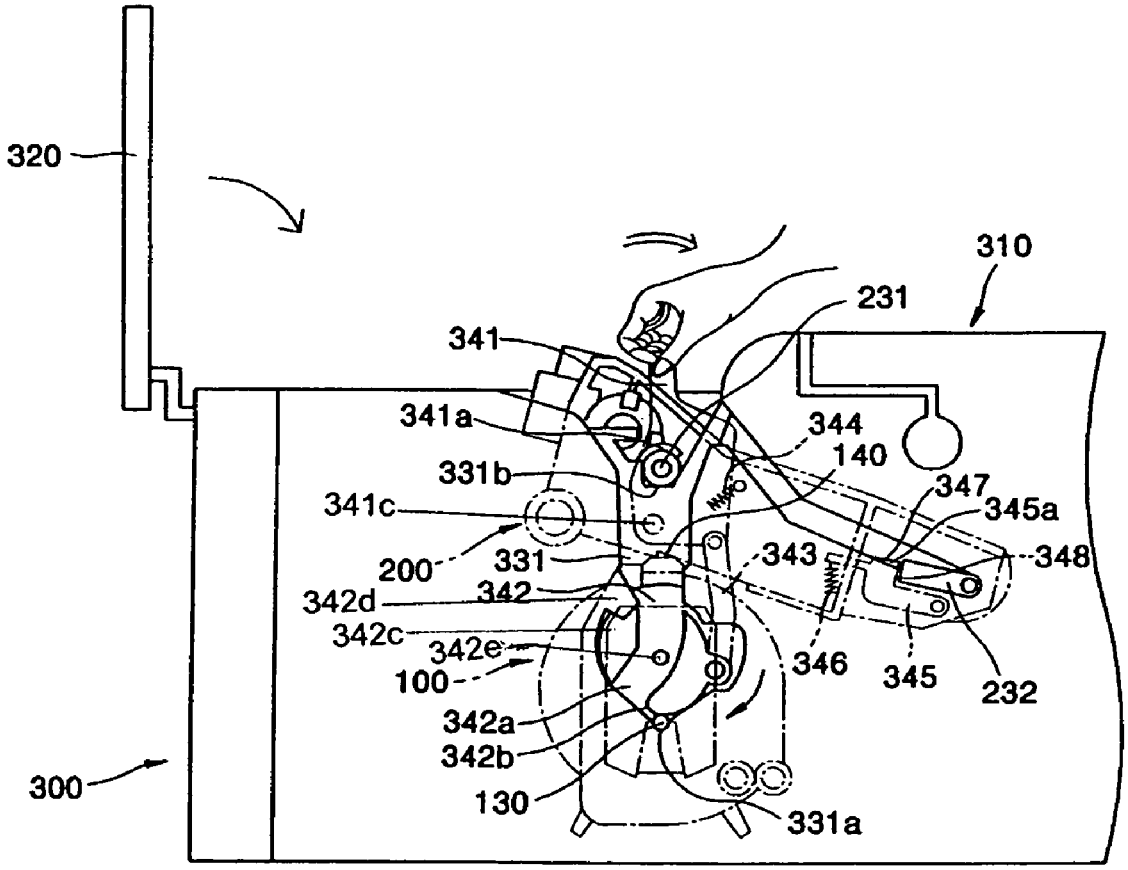

The locking unit may further include a lever shaft 341*c* about which the rotating lever 341 rotates, a cam protrusion 342*c* formed on the rotating cam 342, a cam stopper 342*d* formed on the frame 310 to lock the cam protrusion 342*c* when the second locking portion 342*b* locks the first guide protrusion 130 of the photosensitive unit 100, and a cam shaft 342*e* about which the rotating cam 342 rotates according to a movement of the rotating lever 342, as shown in FIGS. 7 and 11.

If the photosensitive unit 100 and the transfer unit 200 are mounted in the printer body 300 along the first and second guide rails 331 and 332, and then the rotating lever 341 is rotated, the second locking portion 342*b* of the rotating cam 342 lowers the first guide protrusion 130 of the photosensitive unit 100 to lock the photosensitive unit 100 in place. Simultaneously, the first locking portion 341*a* of the rotating lever 341 covers the first guide protrusion 231 of the transfer unit 200 to lock the transfer unit 200 in place. A locked state of each of the locking units is maintained in spite of the elastic force of the spring 344 since the guide protrusion 130 pushes the second locking portion 342*b* upward in response to a downward force from the second locking portion 342*b* of the rotating cam 342 when the second locking portion 342*b* of the rotating cam 342 presses the first guide protrusion 130 of the photosensitive unit 100 toward the lower seating portion 331*a*, so that the rotating cam 342 does not rotate in response to the reaction force of the first guide protrusion 130. However, when the user slightly rotates the rotating lever 341 in the unlocking direction while the locking units are in this state the rotating cam 342 returns to an unlocking state due to a restoration force of the spring 344 while rotating. Therefore, the guide protrusion of the photosensitive unit 100 and the first guide protrusion 231 of the transfer unit 200 are released from the second locking portion 342*b* of the rotating cam 342 and the rotating lever 341, respectively.

Figure 9:
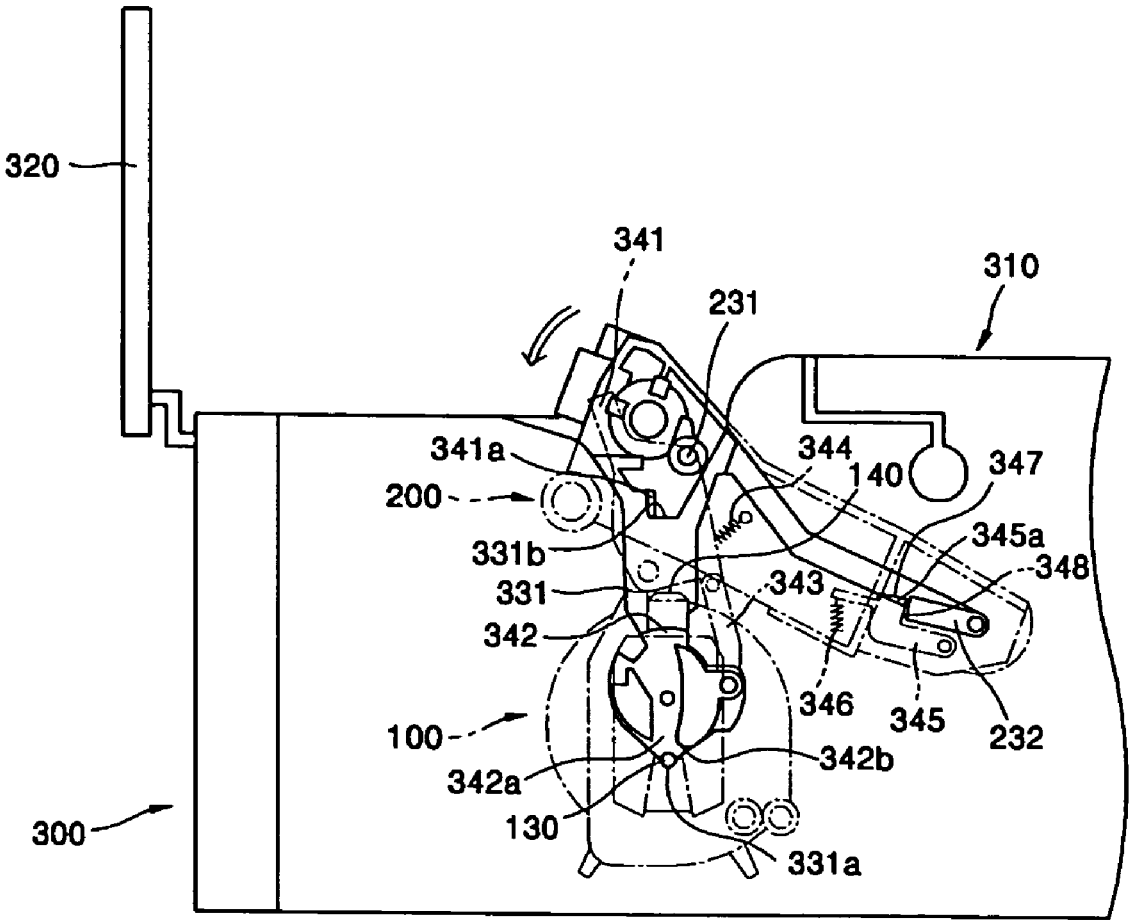
Figure 10:
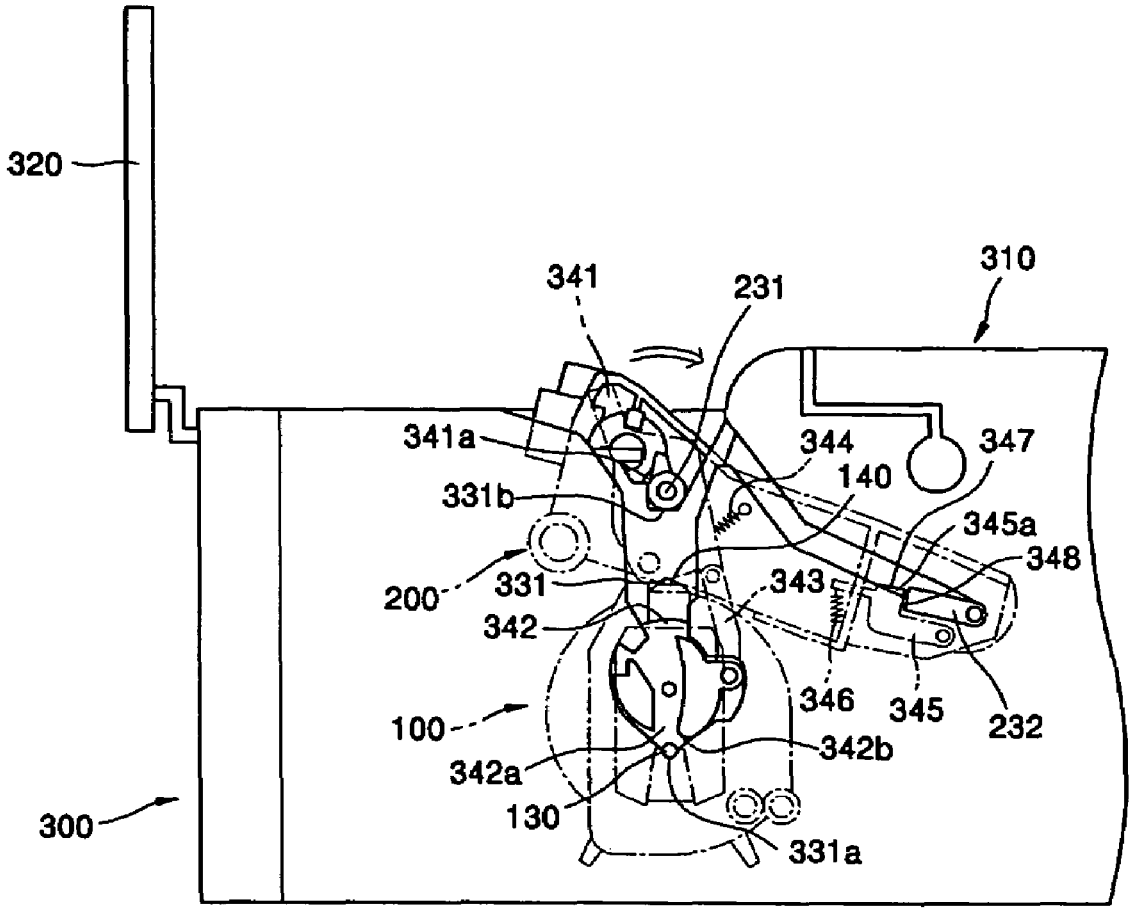

Meanwhile, an auxiliary locking unit, which locks the second guide protrusion 232 of the transfer unit 200, is installed on the second guide rail 332. The auxiliary locking unit includes an interference lever 345 which is rotatably installed in the frame 310, and a spring 346 which elastically biases the interference lever 345 so that a free end 345*a* of the interference lever 345 can protrude toward the second guide rail 332. A slant surface 347, on which the second guide protrusion 232 smoothly moves along the second guide rail 332 when the transfer unit 200 is mounted in the second guide rail 332, is formed on the free end 345*a* of the interference lever 345. A stepped surface 348, which prevents the transfer unit 200 from coming out of the printer body 300, is formed on the free end 345*a* of the interference lever 345. Thus, as shown in FIG. 9, the free end 345*a* of the interference lever 345 allows the transfer unit 200 to enter along the second guide rail 332. However, as shown in FIG. 10, after the transfer unit 200 is seated on the second guide rail 332, the free end 345*a* of the interference lever 345 interferes with the second guide protrusion 232 of the transfer unit 200 in a direction in which the transfer unit 200 is to be removed again from the printer body 300. Thus, in order to remove the transfer unit 200 from the printer body 300 at this point, the first guide protrusion 231 of the transfer unit 200 is lifted into a state shown in FIG. 9, and then is pulled along the second guide rail 332, so that interference between the interference lever 345 and the second guide protrusion 232 of the transfer unit 200 is prevented. The interference lever 345 is installed and operated as described above in order to prevent a friction scratch from occurring on both the photosensitive unit 100 and a transfer belt (not shown) when the transfer unit 200 is pulled out from the printer body 300. The friction scratch may occur both on the photosensitive drum 110 and the transfer belt if the transfer unit 200 is pulled out of the printer body 300 without changing the state where the photosensitive drum 110 contacts the transfer belt (not shown) after the transfer unit 200 is mounted in the printer body 300. Thus, the auxiliary locking unit acts as a safeguard to protect the photosensitive drum 110 and the transfer belt. The auxiliary locking unit allows the transfer unit 200 to be pulled out and removed from the printer body 300 only when the first guide protrusion 231 of the transfer unit 200 is lifted and the photosensitive drum 110 is separated from the transfer belt (not shown).

Hereinafter, when the locking unit includes the rotating lever 341, the rotating cam 342, and the connection bar 343, an operation of mounting and removing the photosensitive unit 100 and the transfer unit 200 in the printer body 300 and from the printer body 300, respectively, will be described.

In the above structure, when a new photosensitive unit 100 and transfer unit 200 are mounted in the printer body 300, the door 320 may be opened, and the new photosensitive unit 100 then can enter the printer body 300 via the upward entrance opened by the door 320, as shown in FIG. 7. As such, the first guide protrusion 130 of the photosensitive unit 100 slides along the first guide rail 331 and is guided into a mounting location. In this case, the rotating cam 342 is in an unlocking state and is connected to the first guide rail 331 so that the rail 342*a* does not prevent the guide protrusion 130 from entering into the lower seating portion 331*a*. In this way, the first guide protrusion 130 of the photosensitive unit 100, lowered along the first guide rail 331, is seated on the lower seating portion 331*a*, as shown in FIG. 8.

Figure 8:
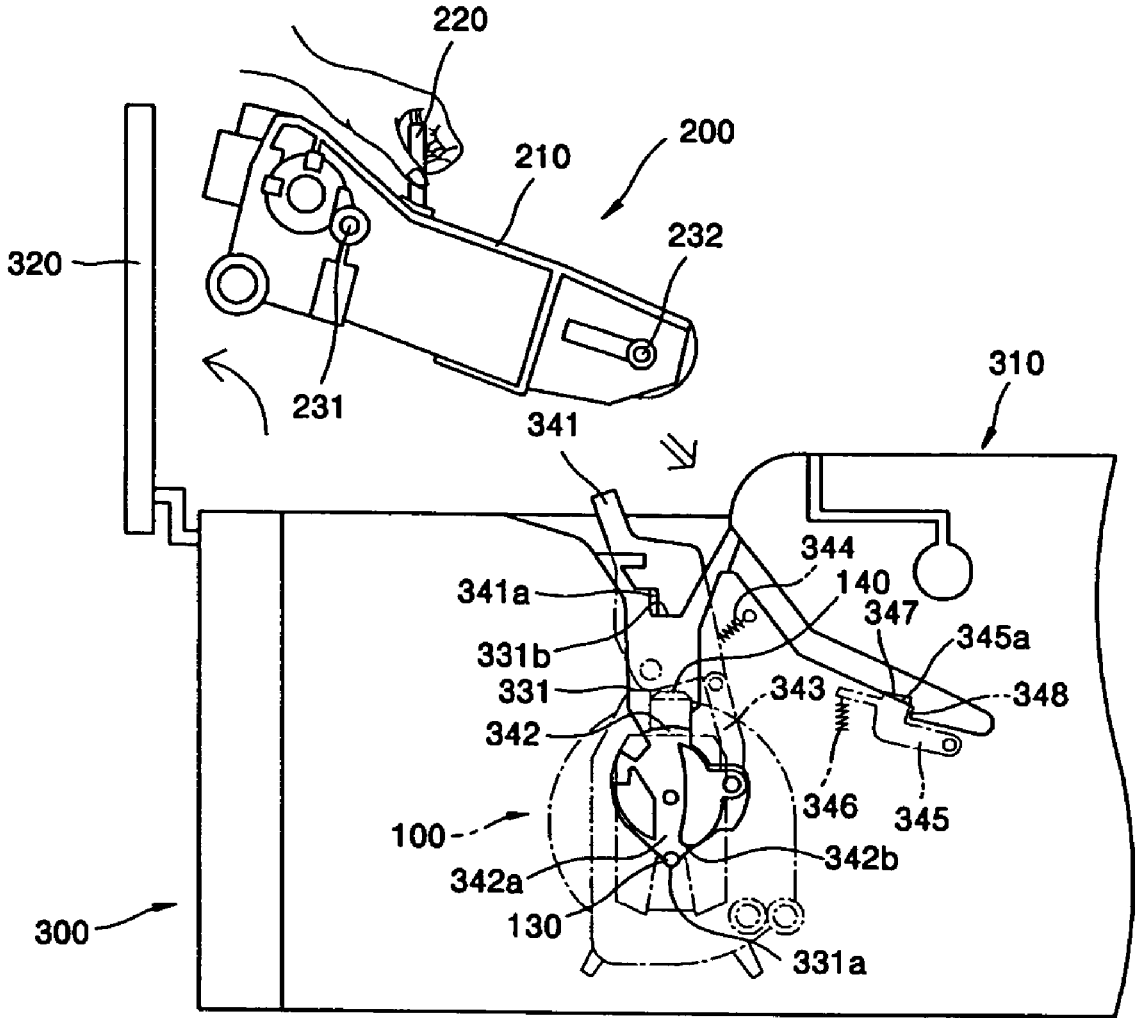

Next, the transfer unit 200 enters into the printer body 300 in the order shown in FIGS. 8 through 10. First, the second guide protrusion 232 of the transfer unit 200 slides along the second guide rail 332 to be disposed into the mounting location. In this case, the second guide protrusion 232 passes across the free end 345*a* of the interference lever 345 to enter an end of the second guide rail 332 disposed in the mounting location, as shown in FIG. 9.

When the second guide protrusion 232 enters completely into the mounting location, the first guide protrusion 231 enters into the first guide rail 331 and is seated on an upper seating portion 331*b* of the first guide rail 331, as shown in FIG. 10. As such, mounting the photosensitive unit 100 and the transfer unit 200 in the printer body 300 is completed. Subsequently, a locking operation of the two units 100 and 200 is performed. The locking operation is performed by rotating the rotating lever 341 of the locking unit. In other words, as shown in FIG. 11, if the user rotates the rotating lever 341 into a locked state, the first locking portion 341*a* of the rotating lever 341 covers the first guide protrusion 231 of the transfer unit 200 to prevent the transfer unit 200 from deviating from an upward direction, and the second locking portion 342*b* of the rotating cam 342 presses the first guide protrusion 130 of the photosensitive unit 100 toward the lower seating portion 331 to lock the photosensitive unit 100 in place. Thus, as long as the rotating lever 341 is not returned to its original location, the two units 100 and 200 are maintained in a stable locked state by the locking unit.

When these units 100 and 200 are removed from the printer body 300, the door 320 is opened to allow a user to access the units 100 and 200 through the entrance of the printer body 300 in a vertical direction, i.e., in an upward or downward direction, the rotating lever 341 is rotated in the unlocking state which is an original location, and then, the transfer unit 200 and the photosensitive unit 100 are sequentially removed from the printer body 300.

Since operations of locking and unlocking the photosensitive unit 100 and the transfer unit 200 are simultaneously performed by opening the door 320 and rotating the rotating lever 341, the operation of replacing the photosensitive unit 100 and the transfer unit 200 can be more conveniently performed as compared to a conventional printer in which a photosensitive unit and a transfer unit are replaced through an opening formed on a side of the conventional printer body. In addition, since the two units 100 and 200 are lifted in an upward direction and removed in a state where the handles 120 and 220 provided on each of the units 100 and 200 are grasped, compared to the conventional method of replacing the photosensitive unit 10 and the transfer unit 20 by grasping front sides of the two units 10 and 20, pulling the units out in a forward direction, i.e., a horizontal direction, and removing them, the possibility that the two units 100 and 200 fall down and become damaged is reduced.

As described above, in the system to replace a photosensitive unit and a transfer unit, the operations of locking and unlocking the two units are simultaneously performed by rotating a rotating lever, and then the two units enter into the printer body 300 via an upward entrance. As such, an operation of replacing the photosensitive unit and the transfer unit is more conveniently and stably performed.

While this invention has been particularly shown and described with reference to preferred embodiments thereof, it will be understood by those skilled in the art that various changes in form and details may be made therein without departing from the spirit and scope of the invention as defined by the appended claims and equivalents thereof.

What is claimed is:

1. A system to replace a photosensitive unit and a transfer unit in a printer, the system comprising:

a printer body having an entrance to access a mounting location;

a frame disposed in the printer body and having the mounting location to receive a photosensitive unit and a transfer unit via the entrance of the printer body;

a door to open and close the entrance of the printer body; and a locking unit, which is provided in the frame to be operable independently of the door to simultaneously lock and unlock the photosensitive unit and the transfer unit in the mounting location.

2. The system of claim 1, further comprising:

guide protrusions formed on the photosensitive unit and the transfer unit; and a guide rail provided in the frame to guide each of the guide protrusions of the photosensitive unit and the transfer unit that enter via the entrance of the printer body to be disposed in the mounting location.

3. The system of claim 2, wherein the photosensitive unit comprises a damping member, the transfer unit is stacked on the photosensitive unit and is elastically supported by the damping member of the photosensitive unit, and the locking unit comprises a rotating lever which is rotatably installed in the frame and which comprises a locking portion to lock the transfer unit so that the transfer unit does not deviate from a direction along which the guide protrusion of the transfer unit enters when the rotating lever is rotated in a locking direction.

4. The system of claim 3, wherein the transfer unit further comprises a second guide protrusion which is locked by the rotating lever, and the guide rail comprises a first guide rail along which the guide protrusion of the photosensitive unit and the guide protrusion of the transfer unit are guided, and a second guide rail along which the second guide protrusion of the transfer unit is guided.

5. The system of claim 4, further comprising:

an auxiliary locking unit which locks the second guide protrusion of the transfer unit.

6. The system of claim 5, wherein the auxiliary locking unit comprises:

an interference lever rotatably installed in the frame; and a spring which elastically biases the interference lever so that a free end of the interference lever protrudes toward the second guide rail;

wherein the free end of the interference lever comprises a slant surface on which the second guide protrusion smoothly moves down along the second guide rail when the transfer unit is mounted in the second guide rail, and a stepped surface which prevents the transfer unit from coming out of the printer body.

7. The system of claim 2, wherein the locking unit comprises:

a rotating lever rotatably installed in the frame;

a first locking portion formed on the rotating lever to lock and unlock the transfer unit so that the transfer unit does not deviate from a direction along which the guide protrusion of the transfer unit enters when the rotating lever is rotated in a locking direction and an unlocking direction;

a rotating cam rotatably installed in the frame and comprises a second locking portion that locks the photosensitive unit by pressing the guide protrusion of the photosensitive unit when the second locking portion is rotated in the locking direction; and a connection bar which connects the rotating cam and the rotating lever so that the rotating cam and the rotating lever move together in one of the locking direction and the unlocking direction.

8. The system of claim 7, wherein the transfer unit further comprises a second guide protrusion, and the guide rail comprises a first guide rail along which the guide protrusion of the photosensitive unit and the guide protrusion of the transfer unit are guided, and a second guide rail along which the second guide protrusion of the transfer unit is guided.

9. The system of claim 8, further comprising:

an auxiliary locking unit which locks the second guide protrusion of the transfer unit.

10. The system of claim 9, wherein the auxiliary locking unit includes:

an interference lever rotatably installed in the frame; and a spring which elastically biases the interference lever so that a free end of the interference lever protrudes toward the second guide rail;

wherein the free end of the interference lever comprises a slant surface, on which the second guide protrusion smoothly moves along the second guide rail when the transfer unit is mounted within the second guide rail, and a stepped surface which prevents the transfer unit from exiting the printer body.

11. The system of claim 2, wherein the photosensitive unit comprises:

a photosensitive drum;

a case which covers a part of the photosensitive drum;

a handle rotatably coupled with the case; and a damping member which shock-absorbingly contacts the transfer unit.

12. The system of claim 1, wherein the transfer unit comprises:

a transfer belt;

a case which covers the transfer belt; and a handle rotatably installed in the case.

13. The system of claim 1, wherein the photosensitive unit and the transfer unit enter the printer body via the entrance formed in an upward direction of the printer body.

14. A printer comprising a photosensitive unit on which an image to be printed is formed through exposure and development operations, a transfer unit which transfers the image formed on the photosensitive unit onto paper, and a system to replace the photosensitive unit and the transfer unit, wherein the system comprises:

a printer body having an entrance to access a mounting location;

a frame provided in a printer body; and a locking unit provided in the frame and simultaneously locks and unlocks a photosensitive unit and a transfer unit that enter via the entrance of the printer body and are seated in the mounting location, wherein the photosensitive unit includes a damping member which shock-absorbingly contacts the transfer unit.

15. (Currently Amended) The printer of claim 14, wherein the system further comprises guide protrusions formed on the photosensitive unit and the transfer unit, respectively, and a guide rail provided in the frame and guides each of the guide protrusions of the photosensitive unit and the transfer unit that enter via the entrance of the printer body to be disposed in the mounting location.

16. The printer of claim 15, wherein the photosensitive unit comprises a damping member, the transfer unit is stacked on the photosensitive unit and is elastically supported by the damping member of the photosensitive unit, and the locking unit comprises a rotating lever rotatably installed in the frame, and a locking portion to lock and unlock the transfer unit so that the transfer unit does not deviate from a direction along which the guide protrusion of the transfer unit enters when the rotating lever is rotated in a locking direction and an unlocking direction.

17. The printer of claim 16, wherein the transfer unit further comprises a second guide protrusion to be locked by the rotating lever, and the guide rail comprises a first guide rail along which the guide protrusion of the photosensitive unit and the guide protrusion of the transfer unit are guided, and a second guide rail along which the second guide protrusion is guided.

18. The printer of claim 17, wherein the system further comprises:

an auxiliary locking unit which locks the second guide protrusion of the transfer unit.

19. The printer of claim 18, wherein the auxiliary locking unit comprises:

an interference lever rotatably installed in the frame; and a spring which elastically biases the interference lever so that a free end of the interference lever protrudes toward the second guide rail;

wherein the free end of the interference lever comprises a slant surface on which the second guide protrusion smoothly moves along the second guide rail when the transfer unit is mounted within the second guide rail, and a stepped surface which prevents the transfer unit from exiting the printer body.

20. The printer of claim 15, wherein the locking unit comprises:

a rotating lever rotatably installed in the frame and comprises a first locking portion to lock the transfer unit so that the transfer unit does not deviate from a direction along which the guide protrusion of the transfer unit enters when the rotating lever is rotated in a locking direction;

a rotating cam rotatably installed in the frame and comprises a second locking portion that locks the photosensitive unit by pressing the guide protrusion of the photosensitive unit when the second locking portion is rotated in the locking direction; and a connection bar which connects the rotating cam and the rotating lever to move together in one direction of the locking direction and an unlocking direction.

21. The printer of claim 20, wherein the transfer unit further comprises a second guide protrusion, and the guide rail comprises a first guide rail along which the guide protrusion of the photosensitive unit and the guide protrusion of the transfer unit are guided, and a second guide rail along which the second guide protrusion of the transfer unit is guided.

22. The printer of claim 21, wherein the system further comprises:

an auxiliary locking unit which locks the second guide protrusion of the transfer unit.

23. The printer of claim 22, wherein the auxiliary locking unit includes:

an interference lever rotatably installed in the frame; and a spring which elastically biases the interference lever so that a free end of the interference lever protrudes toward the second guide rail;

wherein the free end of the interference lever comprises a slant surface on which the second guide protrusion smoothly moves along the second guide rail when the transfer unit is mounted in the second guide rail, and a stepped surface which prevents the transfer unit from exiting the printer body.

24. The printer of claim 14, wherein the photosensitive unit further comprises:

a photosensitive drum;

a case which covers a part of the photosensitive drum; and a handle rotatably coupled with the case.

25. The printer of claim 14, wherein the transfer unit comprises:

atransfer belt;

a case which covers the transfer belt; and a handle rotatably installed in the case.

26. The printer of claim 14, wherein the photosensitive unit and the transfer unit enter the printer body via the entrance formed in an upward direction of the printer body.

27. A printer, comprising:

a frame having an opening therein to receive a photosensitive unit and a transfer unit into a seated position; and a locking unit disposed in the frame and including a rotating lever extending from the frame in the opening to be rotatable in the opening when the photosensitive unit and the transfer unit are in the seated position within the frame such that the photosensitive unit and the transfer unit are locked in a locked position within the frame.

28. The printer of claim 27, wherein the opening is disposed upwardly in the frame and the rotatable lever extends upward in the frame and is rotatable to bias the photosensitive unit and the transfer unit downward to be in contact with each other.

* * * * *